United States Patent [19]

Edwards

[11] Patent Number: 4,528,896

[45] Date of Patent: Jul. 16, 1985

[54] DYNAMIC SEALS FOR GAS AND OIL WELL SWABS

[76] Inventor: Ronald T. Edwards, 4623 Yuma St., NW., Washington, D.C. 20016

[21] Appl. No.: 556,340

[22] Filed: Nov. 29, 1983

[51] Int. Cl.[3] ..... F16J 9/00

[52] U.S. Cl. ..... 92/242; 92/240; 166/202; 277/212 C; 417/555 A

[58] Field of Search ..... 92/242, 240, 241, 245, 92/246, 249; 417/555 A; 277/212 C; 166/202

[56] References Cited

U.S. PATENT DOCUMENTS

| | | | |
|---|---|---|---|
| 1,613,066 | 1/1927 | Turner | 166/202 |
| 2,001,012 | 5/1935 | Burgher . | |
| 2,018,205 | 10/1935 | Evans . | |
| 2,581,981 | 1/1952 | Taylor, Jr. | 92/242 X |
| 2,674,315 | 4/1954 | Brown | 166/202 |
| 2,723,721 | 11/1955 | Corsette | 277/212 C |
| 2,755,862 | 7/1956 | Abendroth et al. | 166/202 X |
| 2,830,540 | 4/1958 | Vincent . | |
| 2,878,754 | 3/1959 | McMurry . | |
| 2,962,978 | 12/1960 | Reeves . | |
| 3,179,022 | 4/1965 | Bloudoff | 417/555 A |
| 3,266,384 | 8/1966 | Scaramucci | 92/242 X |
| 3,422,902 | 1/1969 | Bouchillon | 166/202 |
| 3,456,724 | 7/1969 | Brown | 166/202 X |
| 3,941,510 | 3/1976 | Morgan | 417/57 |
| 4,030,858 | 6/1977 | Coles, Jr. | 417/56 |
| 4,070,134 | 1/1978 | Gramling | 417/56 |
| 4,329,916 | 5/1982 | Roeder | 92/242 X |

*Primary Examiner*—Edward K. Look

[57] ABSTRACT

Gas and oil well swabs, particularly a dynamic seal for maintaining gas-tight contact between the moving swab and the well casing. The seal includes a reinforcing tube and a flexible annulus having an upper throat portion complementally engaging the exterior of the reinforcing tube and a lower bell-shaped skirt portion, engageable with the well casing. The lower bell-shaped skirt portion of the seal defines an expansion chamber for the well gas, which lifts the swab.

7 Claims, 7 Drawing Figures

DYNAMIC SEALS FOR GAS AND OIL WELL SWABS

BACKGROUND OF THE INVENTION (1) Field of the Invention:

Gas and oil well swabs, particularly flexible seals for movable swabs used in raising accumulated liquid within a gas and oil well casing.

DESCRIPTION OF THE PRIOR ART

Being submitted separately in a PRIOR ART STATEMENT.

(2) Summary of the Invention:

A flexible or dynamic annular seal for positioning upon a gas powered automatic swabbing device, such that the seal provides a gas tight closure intermediate the swab and the inner wall of the well casing. The seal is described as "dynamic" since it maintains gas tight contact between the moving swab and the gas well casing, notwithstanding the travel of the swab through 3,000 feet or more of well casing, including the casing pipe joints. The seal may be used individually or within a pair and includes a rigid reinforcing tube or insert and a flexible annular seal which is fitted over the reinforcing tube insert. The flexible annular seal includes a throat portion, a reinforced mid-portion and a flexible skirt, which engages the casing wall. The seal is characterized by its ability to maintain gas-tight contact notwithstanding the abrading effect of moving within the casing and the corroding effect commonly found in chemicals of gas and oil.

DESCRIPTION OF THE PREFERRED EMBODIMENTS

Figure 1:
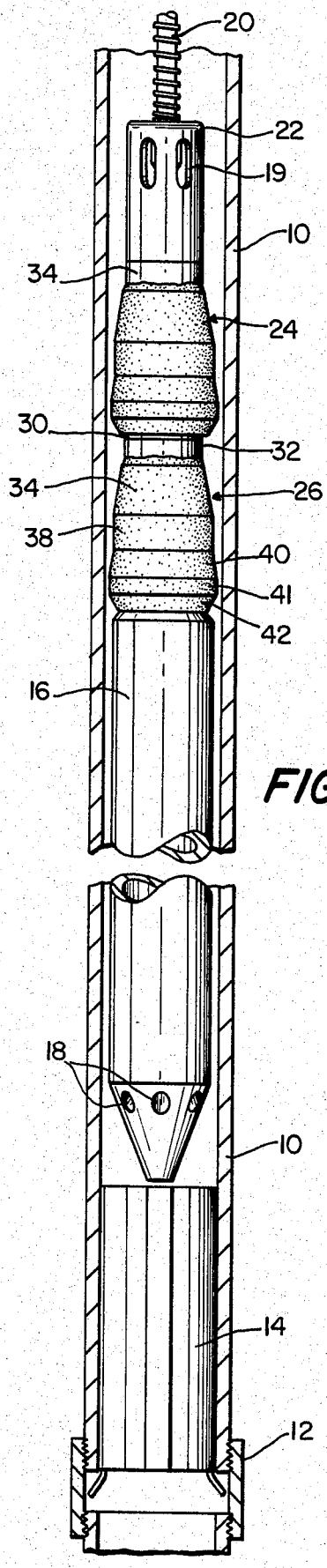
FIG. 1 is a fragmentary elevation, showing a gas and oil well automatic swab fitted with a pair of resilient annular seals.

In FIG. 1 there is illustrated a stand 14 positioned, for example, at the second pipe joint 12 above the well casing perforations, so as to support swab device 16. Swab 16 is illustrated as having gas entry holes 18 and gas exit holes 19 in locking cap member 22, which is fitted over threaded assembly neck tube 20. A pair of flexible seals 24, 26 may be fitted over the swab assembly, so as to be in abutting relationship.

Figure 2:
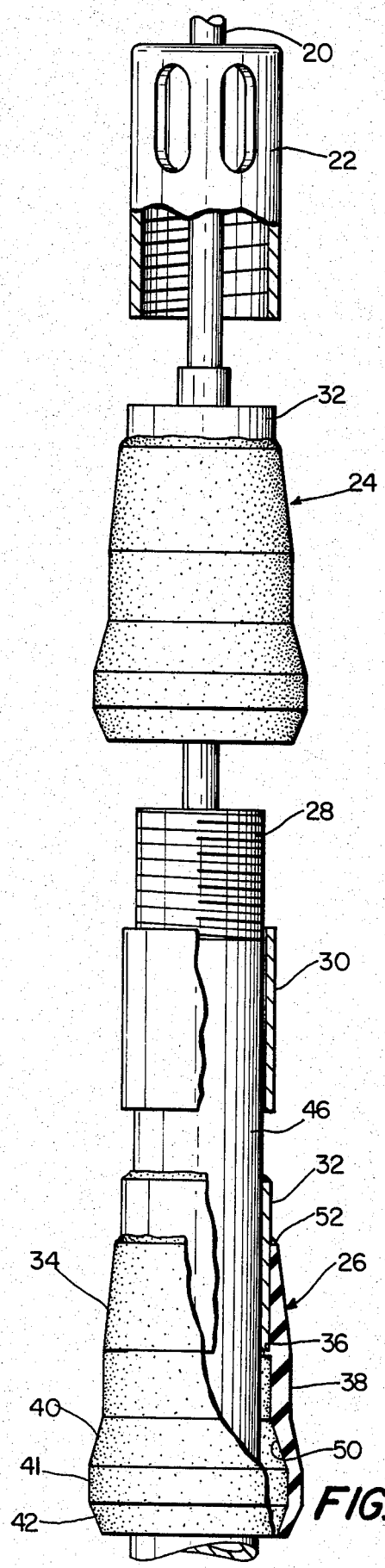
FIG. 2 is an exploded view, showing positioning of a pair of seals upon the coupling tube.

In FIG. 2 the flexible seals 24, 26 are illustrated in the process of assembly by means of axial tube 46 having threads 28 at either end and an intervening exterior spacer piece 30.

The individual flexible seals 24, 26 are identical and, as illustrated in the lower portion of FIG. 2, each include throat portion 34 terminating in top rim 52.

Throat portion 34 encircles reinforcing tube 32, which may have optional interior threads 44. The opposite end of reinforcing tube 32 extends to inner support shoulder 36. Beneath support shoulder 36 reinforced mid-portion 38 of increased thickness extends into skirt portion 40, including an outwardly extending portion 40, mid-portion 41 and inwardly extending portion 42. Although the thickness of reinforced mid-portion 38 is constant, it will be recognized that the thickness of skirt 40 stages may be varied, according to the exigencies of down hole pressure and frictional wear.

As further illustrated in FIGS. 3, 4, 5 and 6, bottom inwardly extending portion 42 terminates in bottom edge 48. The interior of skirt portion 40 includes and inwardly inclined upper shoulder 50 which terminates at the reinforced mid-portion 38.

For practical purposes, the distance between flexible seals 24 and 26, as positioned upon coupling piece 46, is determined by the longitudinal length of the well casing pipe joint, such that one seal maintains gas tight contact and, thus, lifts the swab as the other seal traverses the pipe joint.

Figures 3, 4, 7:
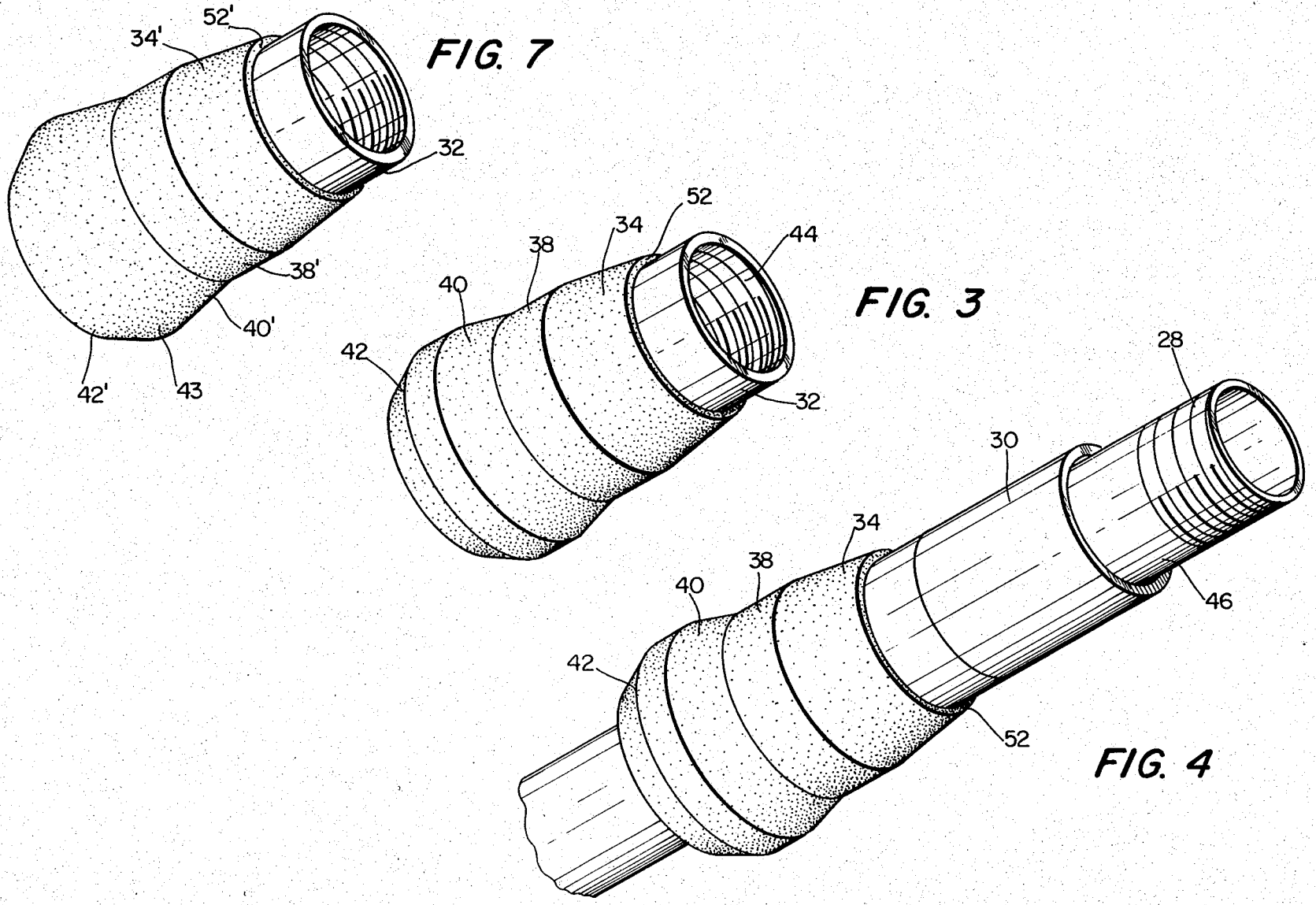
FIG. 3 is a perspective view of an individual seal.
FIG. 4 is a perspective view of an individual seal, as fitted over the swab assembly.
FIG. 7 is a perspective view of a modified seal wherein the stages between the reinforced mid-portion, skirt and inwardly extending bottom portion are rounded.
Figure 5:
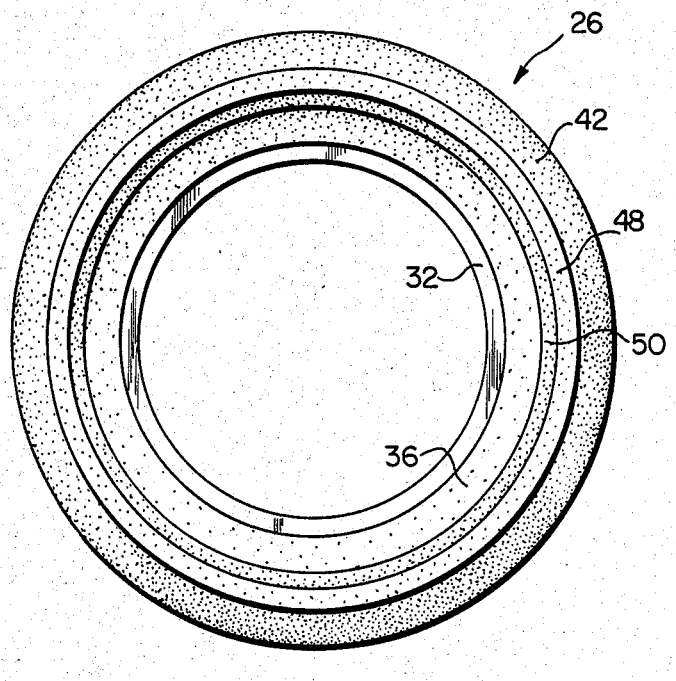
FIG. 5 is an end view through the bottom of the flexible seal.
Figure 6:
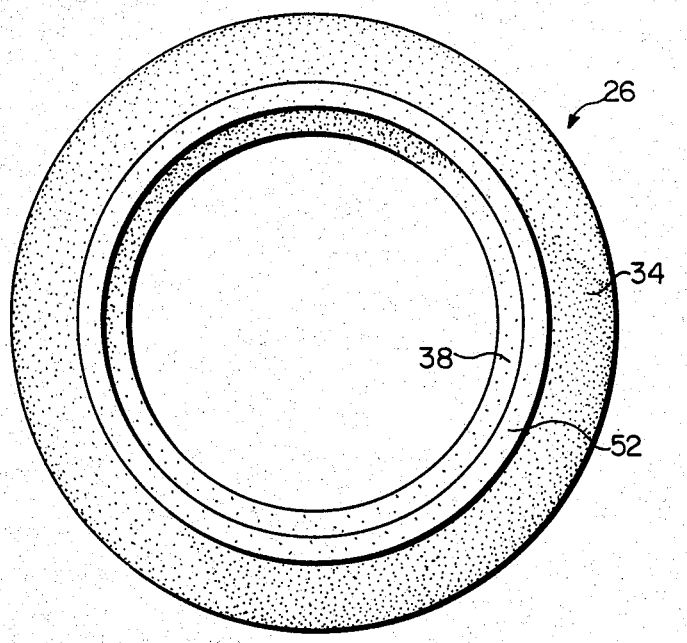
FIG. 6 is a top plan view with the reinforcing tube removed.

A modified seal is illustrated in FIG. 7, wherein the stages between the skirt outwardly extending portion 40, mid-portion 43 and inwardly extending portion 42 are rounded.

In actual use, the swab seal assembly is tightened by means of cap nut 22. One or two gallons of oil may be poured into the casing prior to the first use. However, it is found that in a 3,000 ft. well the swab device is self-lubricating, since less than one or two gallons are retained in the well casing pipe joint threads after swabbing. Reinforced mid-portion 38 provides a rigidity which enables the seals to negotiate the well casing pipe joints in upward and downward travel, both without "wadding" and ballooning out.

According to the teachings of U.S. Pat. No. 4,070,134 in which the present seals may be applied, the retained gas pressure under the swabbing device expands the skirt portion of the seals, notwithstanding travel of the seals through the well casing pipe joints, paraffin, salt rings, scale and the like. The present seal, because of its flexibility, acts as a parachute, since the skirt portion expands outwardly under gas pressure with the seal outer edges in contact with the casing wall, as the swab descends.

In an actual swab assembly, the individual seal, approximately 6 inches in length, was moulded with an outer diameter of 4.090 inches, the throat portion 26 encompassing reinforcing tube 32, which was 3 inches in length. A $5\frac{1}{2}$ inch seal was moulded with an outer diameter of 4.950 inches. The reinforced mid-portion 38 had a wall thickness of $\frac{3}{8}$ inches, the inclined inner shoulder 50 had a length of 7/8 inches and the wall thickness of the skirt portion 40 was 3/16 to $\frac{1}{4}$ inches. The bottom tip of the skirt portion 42 was 3/16 inches in wall thickness. The inner diameter of skirt portion 40 was 3.80 inches. The outer diameter of tubing 32 was 2 7/8 inches and the inner diameter of reinforced threaded tubing 32 was approximately 2.4 inches, with the tube end extending 1 inch above the top rim 42 of the flexible seal throat portion 34.

Seal 26 was moulded from "Nitrile" elastomer material, which is from the chemical group of Butadiene, Acrylonitrile copolymer. The Durometic hardness was in the range 55–60; however, it is believed "Nitrile" or other elastomers in the range 45–85 may be employed.

Manifestly, various elastomer materials may be employed and modifications made in the seal skirt portion dimensions and reinforced tubing without departing from the spirit of the invention. For example, the reinforced tubing may be without interior threads and the several coupling pieces may be variously configured and fitted together.

I claim:

1. In a free-floating, pressure-sensitive automatic swabbing device which requires a seal between the outer surface of said device and an interior wall of a well casing, the improvement of a dynamic form of seal, capable of a gas-tight seal between oil above the seal and gas below the seal, said seal further comprising:

(a) a rigid reinforcing tube operable to be engaged about said swabbing device and having a lower, distal end; and (b) a one-piece, flexible annular seal member of elastomeric material having a Durometric hardness in the range 45 to 85, and essentially comprising an upper throat portion with an inner surface that surrounds said reinforcing tube distal end, so as to support therefrom, in an axially extending fashion, a reinforced mid portion and a lower skirt portion; wherein further (c) said upper throat portion further comprises an inner surface extending substantially axially and an outer surface which is inclined and extends outwardly from the outer surface of said reinforcing tube to a first diameter dimension, proximate said tube distal end, which is greater than said reinforcing tube outer dimension, but less than a second diameter dimension substantially equal to the inner diameter of a well casing in which said seal is intended to operate; and (d) said reinforced mid portion has an outer surface and an inner surface which extends substantially axially, an inner surface diameter dimension substantially equal to that of the upper throat portion inner surface, and an outer surface diameter dimension substantially equal to said first diameter dimension; thereby defining a substantially constant wall thickness for the reinforced mid portion; and (e) said lower skirt portion substantially is bell-shaped, and comprises an outwardly extending portion characterized by an outwardly inclined outer surface, a seal mid portion characterized by an outer surface extending substantially axially with a diameter dimension substantially equal to said second dimension, and an inwardly extending skirt portion, which terminates at a bottom edge and is characterized by an inwardly inclined outer surface, said lower skirt portion further comprising an inner surface characterized by an outwardly inclined upper shoulder surface which extends from said reinforced mid portion inner surface to a point at which said inner surface then substantially follows the contour of said skirt portion outer surface to said bottom edge, so as to define a skirt portion wall thickness substantially less than that of said reinforced mid portion, thereby defining a flexible skirt which is more flexible than said reinforced mid portion, whereby said skirt portion is adapted to act as a parachute, and expand, into tighter sealing contacts with a surrounding well casing in response to increases in gas pressure therebelow.

2. A seal for a gas and oil well swab as in claim 1, said reinforcing tube being threaded interiorally.

3. A seal for a gas and oil well swab as in claim 1, said throat portion overlapping the greater portion of said reinforcing tube, such that an end portion of said tube extends outwardly above said annular seal.

4. A seal for a gas and oil well swab as in claim 3, including as inwardly extending annular shoulder, adjacent said reinforced mid-portion and abutting said reinforcing tube extending into said throat portion.

5. In a gas and oil well swab device, according to claim 1; a pair of said seals mounted upon a rigid tube so as to be aligned and coupled with each other, as an upper extension of the swab device.

6. A seal for a gas and oil well swab as in claim 1, including a coupling piece extending through said pair of seals and having exterior threads at one end, so as to threadedly engage a locking nut cap.

7. A seal for a gas and oil well swab as in claim 6, including an adapter or spacer tube fitted over said coupling piece, so as to limit axial adjustment of said flexible seals with respect to each other.

* * * * *